United States Patent [19]

Lane

[11] Patent Number: 4,684,119

[45] Date of Patent: Aug. 4, 1987

[54] SHEET FEEDING APPARATUS

[75] Inventor: Martin Lane, Hampshire, England

[73] Assignee: De La Rue Systems Limited, London, England

[21] Appl. No.: 625,795

[22] Filed: Jun. 28, 1984

[30] Foreign Application Priority Data

Jul. 25, 1983 [GB] United Kingdom ..... 8319972

[51] Int. Cl.[4] ..... B65H 7/06

[52] U.S. Cl. ..... 271/4; 221/13; 271/3; 271/110; 271/273

[58] Field of Search ..... 271/4, 10, 110, 111, 271/122, 125, 273, 121; 221/13, 21

[56] References Cited

U.S. PATENT DOCUMENTS

| | | | |
|---|---|---|---|
| 2,759,729 | 8/1956 | Hedlun | 271/110 X |
| 3,241,665 | 3/1966 | Erk | 271/273 X |
| 3,701,523 | 10/1972 | Erickson | 270/67 |
| 4,159,782 | 7/1979 | Swartzendruber | 22.1/1 |
| 4,275,874 | 6/1981 | Di Blasio | 271/4 |
| 4,318,540 | 3/1982 | Paananen et al. | 271/110 X |
| 4,474,365 | 10/1984 | Di Blasio | 271/3 |

FOREIGN PATENT DOCUMENTS

| | | |
|---|---|---|
| 0011291 | 5/1980 | European Pat. Off. . |
| 2816371 | 10/1979 | Fed. Rep. of Germany . |
| WO82/02037 | 6/1982 | PCT Int'l Appl. . |
| 1099602 | 1/1968 | United Kingdom . |

*Primary Examiner*—Andres Kashnikow
*Assistant Examiner*—Matthew C. Graham
*Attorney, Agent, or Firm*—Cushman, Darby & Cushman

[57] ABSTRACT

Sheet feeding apparatus for feeding sheets from an input station (4) to an output station (34) comprises selectively actuable stripper mechanism (8) for feeding single sheets from the input station to continuously operable transport mechanism (9,17) which feeds the single sheets to the output station. Sheet detection apparatus (not shown) is provided for checking one or more characteristics of the sheets fed by the stripper mechanism. The arrangement is such that if the detection apparatus detects the presence of a bad or unacceptable sheet, the stripper mechanism is stopped while the transport mechanism transports the bad sheet to the output station.

11 Claims, 3 Drawing Figures

SHEET FEEDING APPARATUS

The invention relates to sheet feeding apparatus for feeding sheets from an input station to an output station. In particular, such sheet feeding apparatus may be incorporated in sorting or counting apparatus such as banknote counting apparatus.

There is a continuing need for small compact sorting and counting apparatus which can rapidly sort or count sheets and which does not take up a great deal of space. One problem with such compact apparatus is that where it is desired to stop the feeding of sheets, for example when a bad or unacceptable sheet is detected, the apparatus will immediately cease operating and the complete drive system will stop. This leads to undesirable wear on the system.

By "bad or unacceptable sheet", we include a sheet which is fed simultaneously with another sheet which would result in two sheets being counted as one, folded sheets, or, particularly in the case of banknotes, a sheet which has failed a check for authenticity.

In accordance with the present invention, sheet feeding apparatus for feeding sheets from an input station to an output station comprises stripper means for feeding single sheets from the input station to transport means which feeds single sheets to the output station; and drive means for continuously driving the transport means and selectively driving the stripper means, the arrangement being such that the stripper means may be selectively stopped while any sheets already fed to the transport means will be transported to the output station by the transport means under the control of the drive means.

This apparatus avoids the problem of the prior art by allowing the drive means continually to drive the transport means while selectively disconnecting the drive means from the stripper means when required.

In one example, the apparatus may further comprise sheet detection means for checking one or more characteristics of the sheets fed by the stripper means, the sheet detection means stopping the stripper means when the presence of a bad sheet, as hereinbefore defined, is detected. Thus, if a bad sheet is detected, the bad sheet will be fed out of the machine by the transport means but no further sheets will be fed by the stripper means, which is stopped. Thus an operator can easily take out the bad sheet from the output station and then reactuate the stripper means. Another useful advantage of the invention is that the feed can be stopped once a complete batch quantity has been fed and this quantity can be preprogrammed. In another example, if it is necessary to divert selected sheets, for example bad sheets, a diverter can be moved into the sheet path as soon as the bad note is detected while at the same time the stripper wheel can be stopped so that no further notes are fed until the diverter is moved out of the path. Thus, rapid actuation of the diverter is only required to insert it into the sheet path.

Conveniently, the apparatus may further include means for stopping the drive means a predetermined time interval after the stripper means has been stopped. An example of such a time interval is 10 seconds.

Preferably, the transport means comprises at least one drive roll in contact with an auxiliary roll to define a nip into which sheets are fed by the stripper means. The stripper means may comprise a stripper roller cooperating with at least one separation roller. It is particularly convenient if the stripper roller is mounted on a shaft having a larger diameter than a shaft on which the or each drive roll is mounted, the stripper roller shaft being eccentrically mounted about the drive roll shaft. The eccentric mounting may be achieved by mounting the stripper roller shaft to a pivoted cradle. With this arrangement nip between the stripper roller and the or each separation roller can be adjusted by causing the cradle to pivot appropriately. This is particularly advantageous in minimising the space required by the stripper means and the transport means.

Preferably, the stripper means and transport means are driven by separate motors but the stripper means could be connected to a transport means drive motor via a clutch.

Conveniently the apparatus further comprises a guide surface extending between the stripper means and the transport means. It is possible that due to wear or other reasons the stripper means may not successfully feed single sheets from the input station to the transport means and two or more sheets may become jammed in the sheet path. Preferably therefore where the apparatus further comprises a guide surface, the guide surface is pivotally mounted to a housing of the apparatus and is movable between a first position in which sheets are guided to the transport means and a second position enabling access to the sheet path between the stripper means and the transport means. The guide surface is preferably securable in the first position and this may be achieved with a clip attached to a non-rotatable shaft of the apparatus. This may be the shaft supporting the auxiliary rolls of the drive means.

An example of sheet feeding apparatus in accordance with the present invention will now be described with reference to the accompanying drawings, in which.

Figure 1:
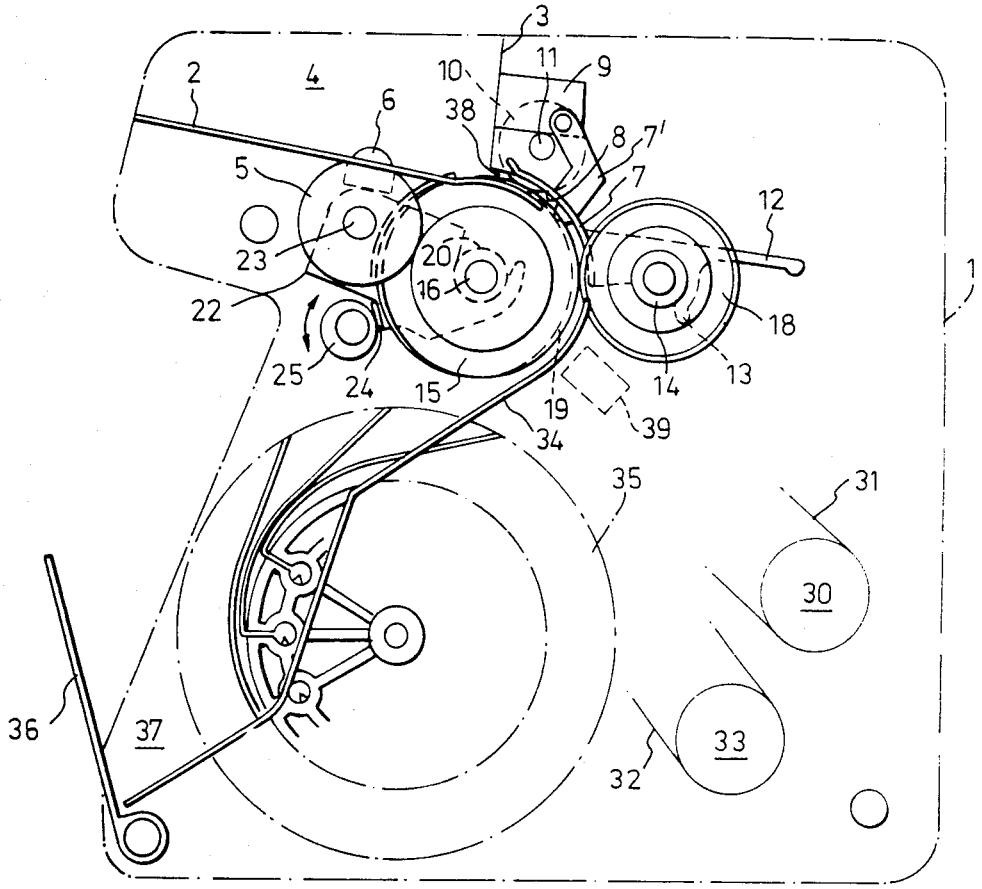
FIG. 1 is a side view of the apparatus.

The apparatus illustrated in the drawings is a banknote counting apparatus but for clarity the means for detecting the banknotes passing through the apparatus to enable the notes to be counted has been shown only schematically. This will however be of a conventional form.

The apparatus comprises a metal housing 1 supporting a base plate 2 and an end plate 3 of an input hopper 4. Two conventional picker wheels 5 are rotatably mounted to the housing 1 and have radially outwardly projecting bosses 6 which, as the picker wheels rotate, periodically protrude through slots in the base plate 2.

A guide plate 7 having a curved guide surface 8 is pivotally mounted by an arm 7' to a lug 9 attached to the end plate 3. Two separation rollers 10 (only one shown in the drawings) are rotatably mounted to a shaft 11. A cantilevered arm 12 is connected to the guide plate 7 and includes a spring clip 13. When the guide plate 7 is in its first position shown, the spring clip 13 is located around a stationary shaft 14. If it is desired to cause the plate 7 to pivot away from its first position, the clip 13 is simply unclipped from the shaft 14 and pivoted in an anti-clockwise direction (as seen in FIG. 1) allowing the operator access to the note feed path so that a note jam can be cleared.

A pair of drive rolls 15 are non-rotatably mounted to a drive shaft 16 which is rotatably mounted to the housing 1. Each drive roll 15 has an outer annular portion 17 of rubber. Each drive roll 15 contacts a respective auxiliary roll 18 rotatably mounted on the shaft 14. For clarity, the guide plate 7 has been omitted from FIG. 2.

Figure 3:
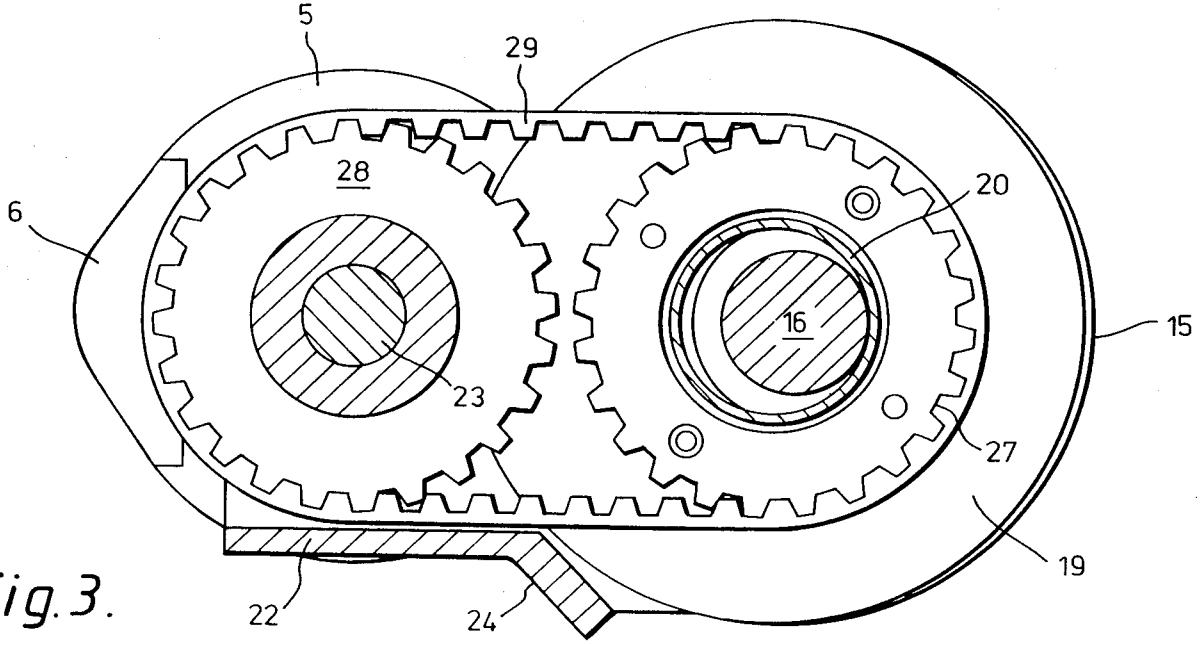

A stripper roller 19 is rotatably mounted on a shaft 20 having a larger diameter than the shaft 16 about which it is positioned. The shaft 20 is secured between a pair of arms 21 of a cradle 22. The cradle 22 is rotatably mounted to an auxiliary drive shaft 23 on which the picker wheels 5 are mounted. The cradle 22 has a cam portion 24 which engages a cam 25 rotatably mounted to the housing 1. (The cam 25 has been omitted from FIG. 3) Manual rotation of the cam 25 adjusts the nip 38 between the stripper roller 19 and the separation rollers 10. A portion of the outer surface of the stripper roller 19 is formed by a rubber section 26. The stripper roller 19 also has a central, annular, toothed groove 27. The auxiliary drive shaft 23 carries non-rotatably a toothed drive wheel 28 mounted in alignment with the groove 27 of the stripper roller 19. A toothed drive belt 29 extends around the drive wheel 28 and into engagement with that part of the groove 27 remote from the auxiliary drive shaft 23.

A drive motor 30 (shown schematically in FIG. 1) continuously drives the drive shaft 16 via a drive belt 31. The connection between the drive belt 31 and the drive shaft 16 has been omitted for clarity. The auxiliary drive shaft 23 is driven via a drive belt 32 by a drive motor 33.

A guide plate 34 extends from adjacent the nips formed between the drive rolls 15 and auxiliary rolls 18 to a conventional stacker wheel 35 rotatably mounted on the housing 1. The guide plate 34 together with an end plate 36 define an output hopper 37.

In use, a stack of banknotes is placed in the input hopper 4. The drive motors 30,33 are actuated so that both the drive shaft 16 and the auxiliary drive shaft 23 rotate. Rotation of the picker wheels 5 causes banknotes at the bottom of the stack to be urged towards the nip 38 between the stripper roller 19 and the separation rollers 10. The separation rollers 10 have been omitted in FIG. 2 for clarity. As the stripper roller 19 rotates in response to the rotation of the auxiliary drive shaft 23, the rubber section 26 will engage the adjacent note and carry this note past the guide surface 8 and into the nip formed between the auxiliaray rolls 18 and drive rolls 15. The nip 38 between the stripper roller 19 and separation rollers 10 will prevent more than one note being fed by the stripper roller 19. Detection means 39 (shown in phantom) including a controlling microcomputer will check the note fed for authenticity and if it determines that the note is not authentic, the drive motor 33 will be braked so that the shaft 23 will stop and the stripper roller 19 will stop rotating and thus prevent further notes from being fed from the stack in the input hopper 4. However, irrespective of the decision of the detecting means, the note will be fed between the drive rolls 15 and the auxiliary rolls 18 due to the continuous rotation of the shaft 16, the note being fed along the guide plate 34 into the stacker wheel 35 which is being rotated by the drive motor 30 and which will stack the note fed in the output hopper 37. If that note is not authentic then no more notes will be fed from the input hopper 4 and it is a simple matter for the operator to pick the bad note from the top of the stack in the output hopper 37.

The auxiliary rolls 18 in conjunction with the shaft 14 may be utilised to detect the passage of more than one note using detection means such as that shown in our European Patent Specification No. 0063159 published under No. WO 82/02037 on June 24, 1982. This detection means may then output a suitable signal when two or more notes are detected, this signal causing engagement of the brake to stop the shaft 23 from rotating. The detection means 39 may be of any conventional type for checking banknotes for authenticity. Typically the detection means 39 and other detection means will include a microcomputer for stopping the stripper roller 19 when a bad note is detected or a predetermined number of sheets have been fed.

Figure 2:
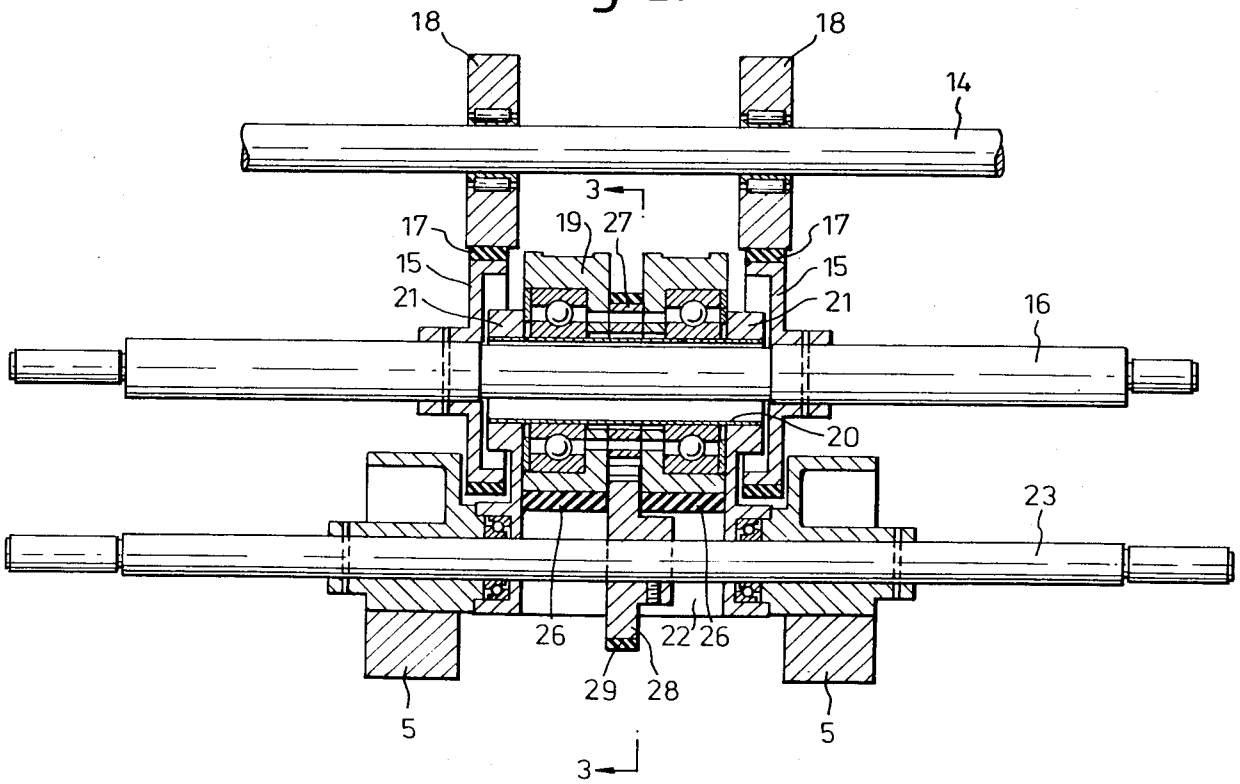
FIG. 2 is a part sectional view illustrating the stripper means and transport means in more detail; and, FIG. 3 is a view taken on the line 3—3 in FIG. 2.

As may best be seen in FIG. 2, it is desirable for the outer surface of the stripper roller 19 adjacent the nips between the rollers 15, 18 to be aligned with the nips. This is so that the rubber portions 26 will not rub the notes so that there is no significant wear and the notes are not dragged into the feed.

I claim:

1. Sheet feeding apparatus for feeding sheets from an input station to an output station, the apparatus comprising stripper means including a stripper roller and at lest one separation roller, said stripper roller cooperating with said at least one separation roller to define a separation nip; transport means including at least one drive roll and auxiliary roll, said rolls being in contact with one another to define a nip into which said sheets are fed by said stripper means, said at least one drive roll being mounted on a drive roll shaft and the or each said auxiliary roll being mounted on an auxiliary roll shaft and wherein said stripper roller is mounted on a stripper roller shaft having a larger diameter than said drive roll shaft, said stripper roller shaft being eccentrically mounted about said drive roll shaft and movable relative to said drive roll shaft to adjust the size of the separation nip, said stripper means being adapted to feed said single sheets to said output station; sensing means adapted to sense the acceptability of sheets fed by said stripper means; and drive means for continuously driving said transport means and for driving said stripper means, the arrangement being such that said stripper means is normally continuously driven but is adapted to be selectively stopped in response to said sensing means sensing the passage of an unacceptable sheet whereupon any of said sheets already fed to said transport means will be transported to said output station by said transport means under the control of said drive means.

2. Sheet feeding apparatus according to claim 1, wherein said stripper roller shaft is mounted to a pivoted cradle.

3. Sheet feeding apparatus according to claim 1, further comprising a guide member defining a guide surface extending between said stripper means and said transport means.

4. Sheet feeding apparatus according to claim 3, wherein the apparatus includes a housing, said guide surface being pivotally mounted to said housing and being adapted to move between a first position in which sheets are guided to said transport means and a second position enabling access to said sheet path between said stripper means and said transport means.

5. Sheet feeding apparatus according to claim 4, further comprising a stationary shaft non-rotatably mounted to the housing, and a clip connected to said guide member, wherein said guide surface is securable in said first position by attaching said clip to said stationary shaft.

6. Sheet feeding apparatus according to claim 1, wherein said drive means comprises two drive motors, one for driving said stripper means and the other for driving said transport means.

7. Sheet feeding apparatus according to claim 1, further comprising rotatable stacker means positioned at said output station and adapted to be continuously driven by said drive means, whereby sheets fed to said output station are stacked by said stacker means.

8. Sheet feeding apparatus according to claim 1, wherein said output station is accessible to a user, whereby unacceptable sheets are removable from said output station by said user.

9. Sheet feeding apparatus according to claim 1, further comprising a rotatably mounted cam coupled with said stripper roller shaft to cause said stripper roller shaft to move relatively to said drive roll shaft.

10. Banknote feeding apparatus for feeding banknotes from an input station to an output station, the apparatus comprising stripper means including a stripper roller and at least one separation roller, said stripper roller cooperating with said at least one separation roller to define a separation nip; transport means including at least one drive roll and auxiliary roll, said rolls being in contact with one another to define a nip into which said sheets are fed by said stripper means, said at least one drive roll being mounted on a drive roll shaft and the or each said auxiliary roll being mounted on an auxiliary roll shaft and wherein said stripper roller is mounted on a stripper roller shaft having a large diameter than said drive roll shaft, said stripper roller shaft being eccentrically mounted about said drive roll shaft and movable relative to said drive roll shaft to adjust the size of the separation nip, said stripper means being adapted to feed single banknotes from said input station to said transport means, and said transport means being adapted to feed said single banknotes to said output station; sensing means adapted to sense the acceptability of banknotes fed by said stripper means; and drive means for continuously driving said transport means and for driving said stripper means, the arrangement being such that said stripper means is normally continuously driven but is adapted to be selectively stopped in response to said sensing means sensing the passage of an unacceptable banknote, whereupon any of said banknotes already fed to said transport means will be transported to said output station by said transport means under the control of said drive means.

11. Banknote counting apparatus for feeding banknotes from an input hopper to an ouput hopper, the apparatus comprising stripper means including a stripper roller and at least one separation roller, said stripper roller cooperating with said at least one separation roller to define a separation nip; transport means comprising at least one drive roll and auxiliary roll, said rolls being in contact with one another to define a nip into which said sheets are fed by said stripper means, said at least one drive roll being mounted on a drive roll shaft and the or each said auxiliary roll being mounted on an auxiliary roll shaft and wherein said stripper roller is mounted on a stripper roller shaft having a larger diameter than said drive roll shaft, said stripper roller shaft being eccentrically mounted about said drive roll shaft and movable relative to said drive roll shaft to adjust the size of the separation nip, said transport means being adapted to feed said single sheets to said output hopper; sensing means adapted to sense the acceptability of banknotes fed by said stripper roller; and two drive motors for continuously driving said transport means and for driving said stripper roller respectively, the arrangement being such that said stripper roller is normally continuously driven but is adapted to be selectively stopped in response to said sensing means sensing the passage of an unacceptable banknote, whereupon any of said sheets already fed to said transport means will be transported to said output hopper by said transport means under the control of said transport means drive motor.

* * * * *